US006795988B2

(12) United States Patent
Hueppe

(10) Patent No.: US 6,795,988 B2
(45) Date of Patent: Sep. 28, 2004

(54) BED, PARTICULARLY A HOSPITAL OR NURSING BED

(75) Inventor: Michael Hueppe, Witten (DE)

(73) Assignee: Voelker AG, Witten (DE)

( * ) Notice: Subject to any disclaimer, the term of this patent is extended or adjusted under 35 U.S.C. 154(b) by 0 days.

(21) Appl. No.: 10/449,011

(22) Filed: Jun. 2, 2003

(65) Prior Publication Data

US 2003/0229941 A1 Dec. 18, 2003

(30) Foreign Application Priority Data

Jun. 13, 2002 (DE) ..... 102 26 231

(51) Int. Cl.[7] ..... A47C 21/08
(52) U.S. Cl. ..... 5/426; 5/424; 5/430; 5/429
(58) Field of Search ..... 5/424, 425, 426, 5/428, 429, 430

(56) References Cited

U.S. PATENT DOCUMENTS 5,381,571 A 1/1995 Gabhart
6,374,437 B1 4/2002 Voelker

FOREIGN PATENT DOCUMENTS

| | | |
|---|---|---|
| DE | 1 718 671 | 3/1958 |
| DE | 7324686 | 7/1973 |
| DE | 44 00 802 A1 | 7/1995 |
| DE | 298 24 011 U1 | 4/2000 |
| EP | 0 991 344 B1 | 11/2001 |
| EP | 1 174 106 A2 | 1/2002 |
| GB | 1 279 081 | 6/1972 |

*Primary Examiner*—Teri Pham Luu
(74) *Attorney, Agent, or Firm*—Birch, Stewart, Kolasch & Birch, LLP

(57) ABSTRACT

A bed having supporting elements for supporting the bed on a floor and a mattress support device for supporting a mattress. The mattress support device is provided with a support member that has two transverse bars extending transversely. A safety side part is supported at the support member so as to be moved between a rest position in which it is located below the lying surface and an upright position in which the safety side part extends at a side of a lying surface. An upper surface of the support member defines a mattress support plane and upper faces of the transverse bars are substantially juxtaposed to the mattress support plane.

10 Claims, 5 Drawing Sheets

BED, PARTICULARLY A HOSPITAL OR NURSING BED

BACKGROUND OF THE INVENTION

1. Field of the Invention

The invention relates to a bed which is a hospital or nursing bed in particular and which is provided with safety side parts for laterally limiting the lying surface.

2. Description of Related Art

A bed of the afore-mentioned kind is known from British Patent 1 279 081 and German Patent 44 00 802. This known bed is equipped with a displaceable lower frame on which an upper frame is arranged. The upper frame comprises a bed frame consisting of a head portion, a foot portion as well as two side portions. A preferably adjustable mattress support device is arranged within the frame, on which a mattress defining the lying surface is located. At the two side portions of the bed frame, grid-like safety side elements are arranged. Each safety side part comprises a longitudinal bar extending parallel to the respective side portion and above this side portion and being connected with the bed frame side portion via several connecting bars parallel to each other. All connections between the connecting bars on the one hand and the bed frame side portion as well as the longitudinal bar on the other hand are articulated and comprise steering axles extending transversely to the longitudinal extension of the bed. Thus, it is possible to pivot the safety side part into an upright position by lifting, in which it raises above the lying surface, and into a lowered position in which the longitudinal bar is supported on the bed frame side portion and is thus arranged below the lying surface so that the patient is able to comfortably get out of the bed.

In principle, the known safety side part construction has proved worthwhile. With respect to its construction, however, it is relatively complicated.

Further, hospital beds are known from prior art where the safety side parts according to the afore-described construction are arranged at the outside of the bed frame and the lying surface, respectively, the bed frame side portions and the lying surface, respectively, and the longitudinal bar being arranged at sides of the connecting bars facing away from each other. Thus, it is possible to pivot the safety side part downward to below the lying surface as well and, if necessary, even to below the bed frame.

From German Utility Model 17 18 671, a bed is known which is provided with lateral plates which are pivotably arranged below the lying surface and are adapted to be folded up for purposes of shielding and screening. If these screening or shielding plates are not used, they will be pushed under the lying surface from both sides and accommodated there. Only in the state of being pushed in and folded up, the position of the plates of the known bed is more or less stable. Therefor, the application range of the plates is limited to that of shielding and screening.

From German Utility Model 73 24 686, a cot is known where the side parts are arranged at the bed frame so as to be adjustable in height. Finally, a bed is known from U.S. Pat. No. 5,381,571 where a head portion-side and a foot portion-side safety side part is arranged at each side of the lying surface. The clearance between these two safety side parts can be closed by a third safety side part that is arranged at one of the two other safety side parts in an articulated manner.

Further, a hospital or nursing bed is known from EP-B-0 991 344 and German Utility Model 298 24 011, respectively, where the safety side parts are brought in their rest position below the mattress support device or rather an adjustable support portion of the mattress support device. A bed with a safety side part adapted to be pivoted into a rest position in this manner is also known from European Patent 1 174 106.

Pivoting the safety side parts into a position below the lying surface and, as known from EP-B-0 991 344, German Utility Model 298 24 011 and European Patent 1 174 106, below the mattress support device supporting the mattress with the lying surface when they are not used has the advantage that the safety side parts do not restrict the accessibility of the bed for the patient and the hospital or nursing personnel in their position of non-use.

In order to increase the comfort, it is increasingly demanded for hospital or nursing beds that the minimum height to which the bed can be lowered is further reduced.

SUMMARY OF THE INVENTION

Therefore, it is an object of the invention to provide a bed, particularly a hospital or nursing bed, where the safety side parts are adapted to be accommodated below the lying surface in a room-saving manner.

In order to solve this object, the invention suggests a bed, particularly a hospital or nursing bed, which is provided with a bedstead comprising supporting elements for supporting on a ground and a frame supported by supporting elements, with a head portion, a foot portion and at least one connecting portion connecting them, a mattress support device for a mattress defining a lying surface laterally limited by longitudinal edges, the mattress support device being provided with at least one support member with two transverse bars spaced from each other and extending transversely to the extension of the at least one connecting element of the bedstead and comprising side faces which face each other and which face away from each other, and at least one safety side part supported at the at least one support member of the mattress support device so as to be moved between a rest position in which it is located below the lying surface and an upright position in which the safety side part extends at the side of the lying surface beyond the latter.

With such a bed, it is provided, according to the invention, that the at least one safety side part is movably supported at the side faces of the transverse bars of the at least one support member of the mattress support device.

According to the invention, it is hence provided to support the at least one safety side part in the plane drawn up by the at least one support member of the mattress support device when it is in the position of non-use (referred to as rest position above). From its upright position, the safety side part gets into this position either exclusively by pivoting or by a combination of a pivoting and a displacing movement. As to that, it is thus provided, according to the invention, that the at least one safety side part is movably supported at the side faces of the transverse bars of the at least one support member of the mattress support device. Therefore, this bearing is either a rotary bearing or a linear guidance with a combined rotary bearing.

According to the construction according to the invention, the safety side part does not project or only slightly projects beyond the underside of the support member of the mattress support device in its rest position. Thereby, an extremely space-saving construction is given that now allows to lower this bedstead to a minimum minimum height if it is a height-adjustable bedstead, as is increasingly demanded for reasons of comfort.

In an advantageous embodiment of the invention, it is provided that the at least one support member of the mattress support device comprises longitudinal bars connecting the two transverse bars for forming a circumferential frame, the two longitudinal bars extending parallel to the at least one connecting portion of the bedstead. It is now possible to arrange accessories such as a urine bottle or a urine bag or a vessel for body liquid, e.g., wound secretion, at these (outer) longitudinal bars substantially extending at the height of the longitudinal edges of the lying surface. These accessories are thus located in the lateral outer region of the bed and are thus easily accessible, which is advantageous as to this. Moreover, the longitudinal bars may exert the function of stops restricting the movement of the at least one safety side part in its rest position. This is particularly useful when the at least one safety side part, after being pivoted out of its upright position, is subsequently displaced into the rest position by a linear displacement. In case of a pure pivotal movement of the at least one safety side part between the rest position and the upright position, the longitudinal bars of the support member do not have the function of a stop in the first place.

As already mentioned above, according to the invention, the at least one safety side part is supported at the side faces of the transverse bars of the at least one support member of the mattress support device. Basically, it is possible to support the at least one safety side part at the internal side faces of the transverse bars, which face each other or at the external side faces of the transverse bars, which face away from each other. The latter is advantageous in that it is now possible to arrange a head portion-side or foot portion-side arm of the safety side part in immediate proximity to the head and foot portions of the bedstead. For, by bearing the safety side part at the outside of the side faces of the transverse bars, this safety side part can thus reach close to the head portion and foot portion of the bed frame, respectively, when being arranged at the head portion-side or foot portion-side support member of the mattress support device, respectively. Thus, only a rather small gap or small distance is created between the head portion or foot portion at the one hand and the respectively neighboring safety side part, which still remains relatively small when the support member is pivoted. This means that the patient or body parts of the patient cannot get between safety side part and head portion or foot portion just like that.

Suitably, the at least one safety side part can be linearly displaced from its rest position over the longitudinal edges of the lying surface of the mattress into a position of maximum withdrawal in order to be transferred into the upright position by a pivotal movement upon reaching this position. Thus, the at least one safety side part is displaceably guided at the side faces of the transverse bars of the at least one support member of the mattress support device. This is suitably effected by means of a (slide) bearing block that is guided along a guide rail or a guide groove at the transverse bar. At the bearing block, the actual safety side part is supported in an articulated manner, about an axle extending in parallel to the longitudinal edges of the lying surface. In the case of a guide rail at the transverse bar, the bearing block has a recess into which the guide rail is immersed. Vice versa, the bearing block has a projection immersing into the guide groove when the transverse bar is provided with a guide groove.

As an alternative to the afore-described bearing possibilities of the safety side part at the transverse bars, it is also conceivable to provide rolling bearings along which the at least one safety side part or its arms are guided at the support member of the mattress support device or its transverse bars. In this case, the construction is similar to that of drawer rails for drawers, for example, as are basically known in furniture construction.

For reasons of safety, it is useful if it is possible that the safety side part can be locked in its upright position, particularly automatically, against unintended movements out of the upright position. Preferably, the locking device required therefor should be adapted to be manually deactivated. In the case of the configuration of the at least one support member of the mattress support device with a circumferential frame, the actuating element required therefor is suitably attached to or arranged at the longitudinal bars of this frame so that the locking of the safety side part in its upright position can be abolished by one-hand operation.

Thus, the invention suggests a hospital or nursing bed the mattress support device of which has an overall height substantially defined by the height of the transverse bars and simultaneously still serves to support the at least one safety side part. If such a mattress support device is used with a height-adjustable bed, the minimum height to which the bedstead can be lowered is no longer restricted by a space requirement for the safety side part in its rest position below the mattress support device. This means that the structural height of the mattress support device of the bed according to the invention is as small as possible, which, in turn, is advantageous for the lowerability of the bedstead and the possibility of moving a lift or the like under the bed and further with respect to the attachment of accessories (urine or wound secretion receptacles, for example).

BRIEF DESCRIPTION OF THE DRAWINGS

Hereinafter, the invention will be explained in detail with respect to an embodiment thereof with reference to the drawing. In the Figures.

DETAILED DESCRIPTION OF A PREFERRED EMBODIMENT OF THE INVENTION

Figure 1:
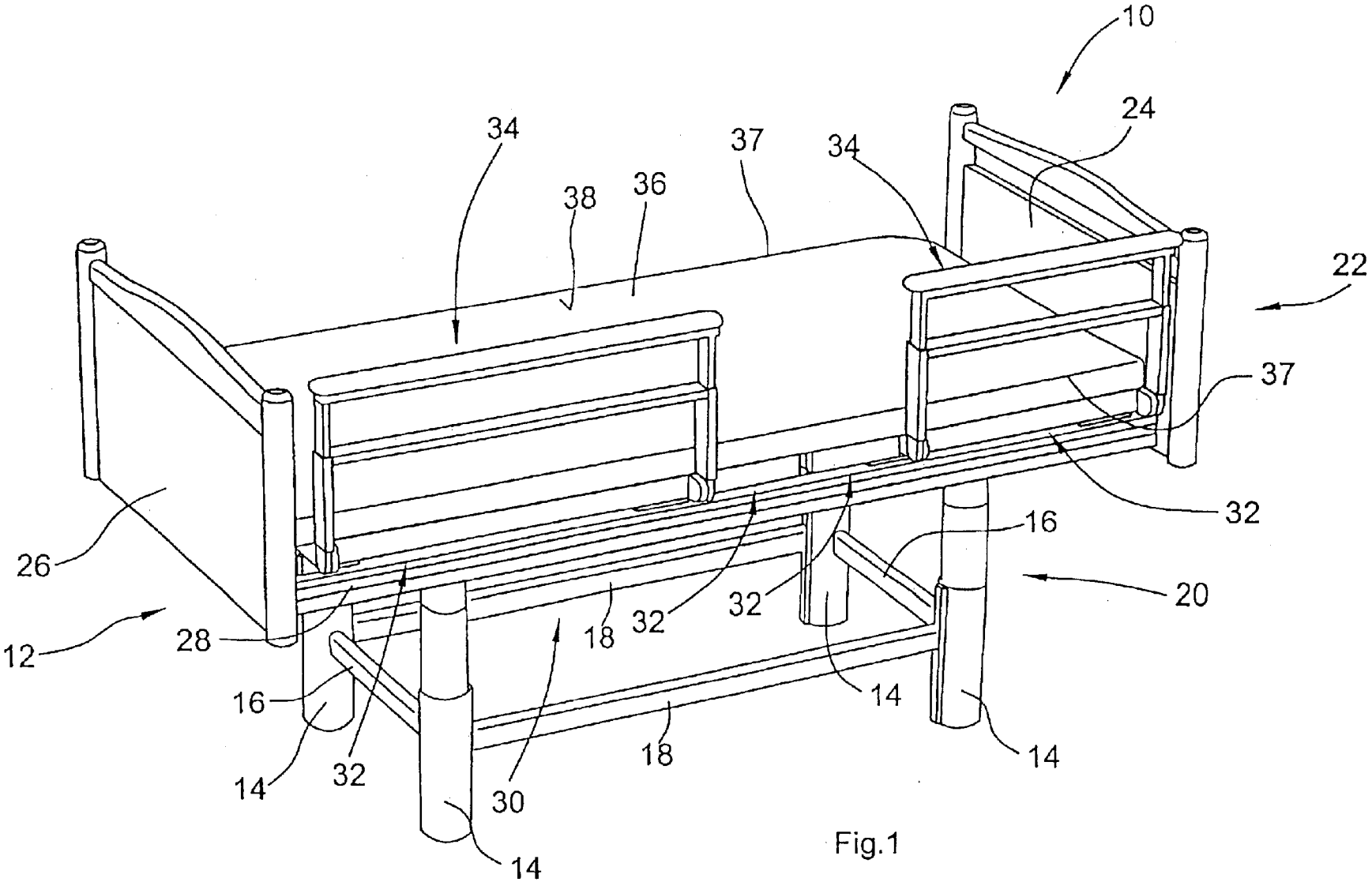
FIG. 1 is a perspective illustration of a hospital or nursing bed with safety side parts articulated according to the invention.

FIG. 1 perspectively shows a hospital or nursing bed 10 with a height-adjustable bedstead 12. The bedstead 12 comprises supporting elements 14 in the form of legs the length of which can be changed and which are interconnected by transverse and longitudinal arms 16, 18 that form, together with the supporting elements, a lower frame 20. On the lower frame 20, an upper frame 22 is borne that comprises a head portion and a foot portion 24, 26 as well as two longitudinal arms 28 connecting them. Further, a mattress support device 30 with several adjustable support members 32 one of which faces the head portion 24 and another one of which faces the foot portion 26 is located at the upper frame 22. At each of these two support members 32, two safety side parts 34 are supported. Finally, a mattress 36 is borne on the mattress support device 30, which defines a lying surface 38 limited by longitudinal edges 37.

The attachment and displaceable guidance of the safety side parts 34 at the respective support members 32 of the mattress support device 30 is well to be seen in FIGS. 2 to 5. Accordingly, a support member 32 comprises a circumferential frame 40 composed of two transverse bars 42 and two longitudinal bars 44 and provided with frame slats 46 or the like. The transverse bars 42 comprise (internal and external) side faces 48; at the (external) side faces 48 facing away from each other, slide bearing blocks 50 are displaceably guided with which the safety side part 34 is connected in an articulated manner.

Figure 2:
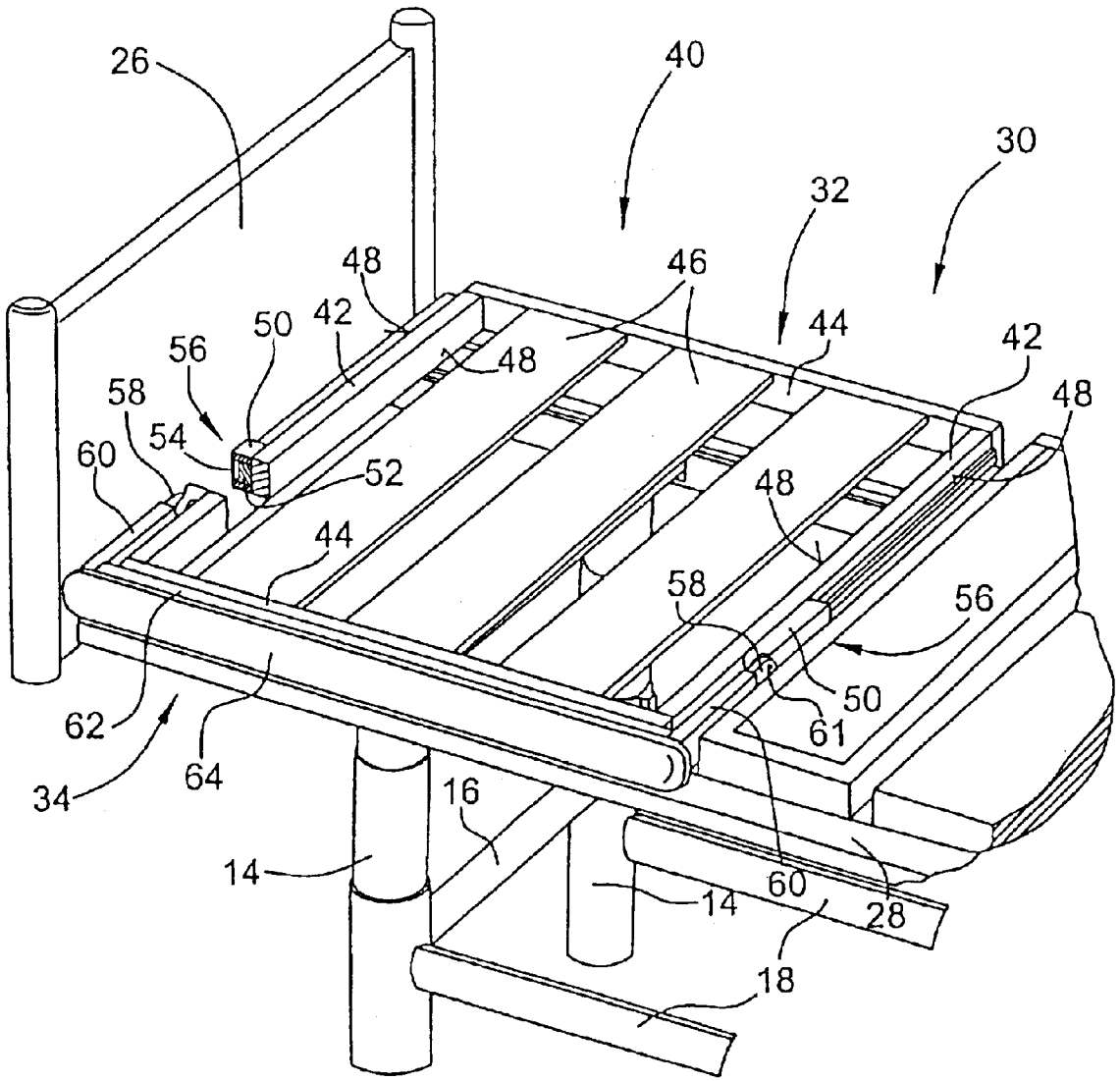
FIG. 2 shows an enlarged representation of the arrangement of a safety side part at the foot-portion side end of the bed in its rest position.
Figure 3:
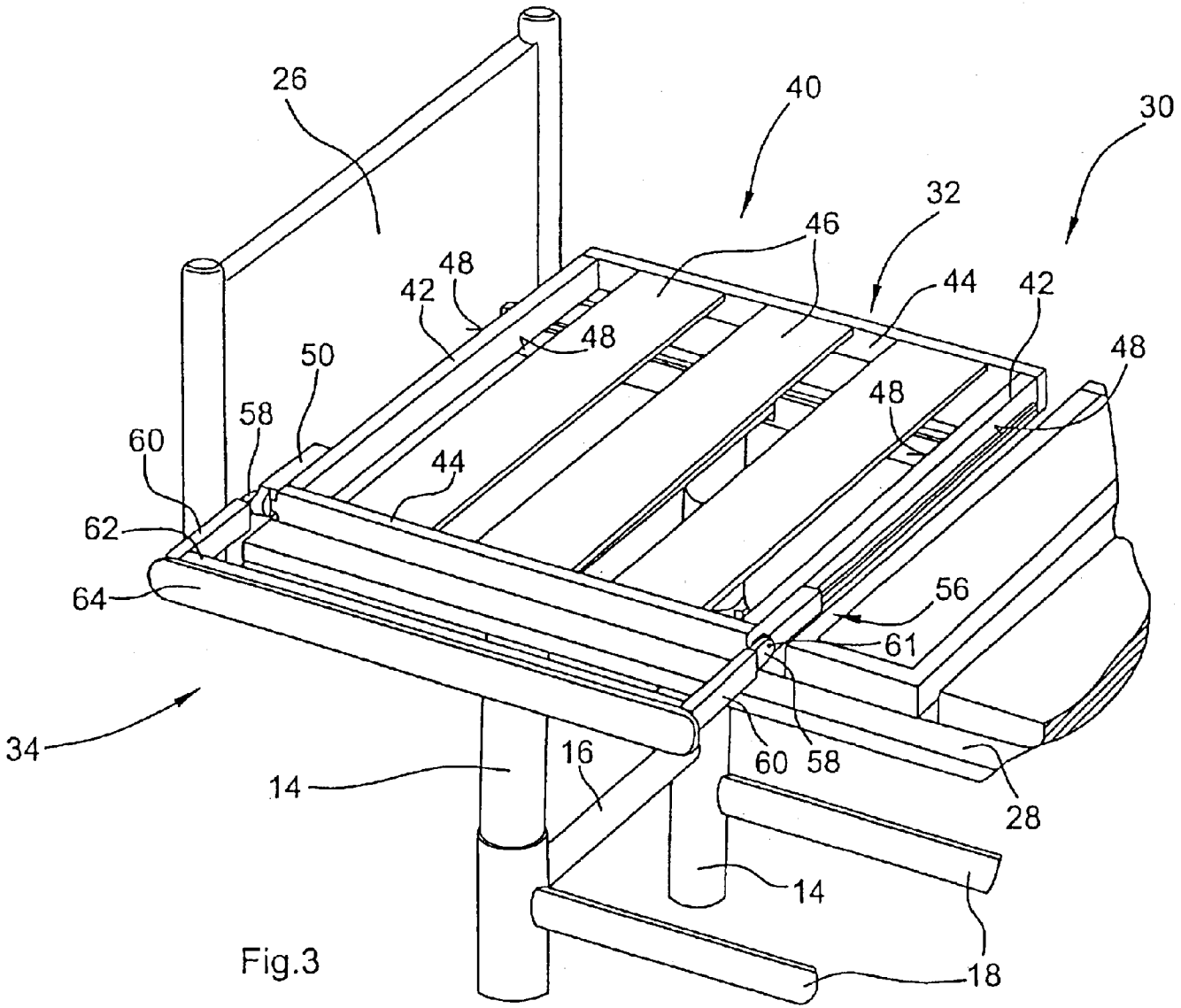
FIG. 3 shows an enlarged representation of the arrangement of the safety side part at the foot-portion side end of the bed in its horizontal projecting position.
Figure 4:
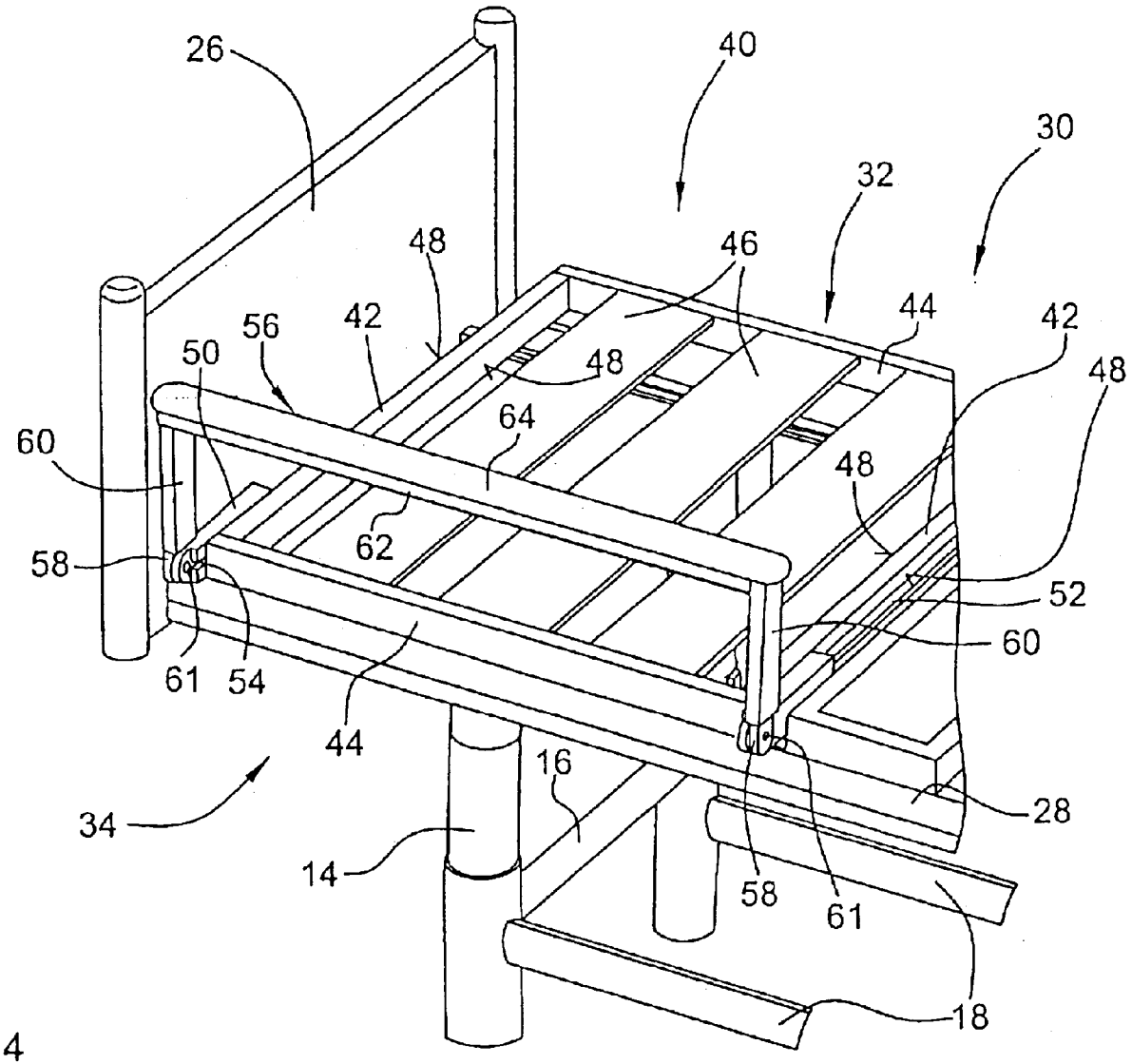
FIG. 4 shows an enlarged representation of the arrangement of the safety side part at the foot-portion side end of the bed, pivoted from its projecting position into its upright position.

To be able to displaceably guide the slide bearing blocks 50 at the transverse bars 42, they comprise guide rails 52 immersing into guide grooves 54 of the slide bearing blocks 50 (refer to the cut-away section II in FIG. 2).

Each slide bearing block 50 forms part of a two-part joint 56 the one joint part of which is the slide bearing block 50 and the other joint 58 of which is connected with a lateral arm 60 of the safety side part 34. The joint axles 61 of both joints 56 extend parallel to the longitudinal edges 37 of the lying surface 38. The two lateral arms 60 are connected with each other via a connecting arm 62. A longitudinal bar 64 of the safety side part 34 extends parallel to the connecting arm 62 and its ends are provided with projecting arms 66 telescopically guided in the lateral arms 60 (refer to FIG. 5).

In the rest position according to FIG. 2, the safety side part 34 is arranged in the plane of the support member 32. In order to transfer it into the upright position according to FIG. 5, it is first transferred into the intermediate position according to FIG. 3 by a movement of withdrawal. (Non-illustrated) stops make sure that the safety side part 34 cannot be withdrawn beyond the position of maximum withdrawal according to FIG. 3. In the position of maximum withdrawal, the joint axles 61 project beyond the longitudinal edges 37 of the lying surface 38 or are in alignment therewith (respectively viewed in vertical projection). Now, the safety side part 34 can be pivoted upward about the joint axles 61 into the upright position according to FIG. 4. In the upright position, the safety side part 34 is locked automatically or after the manual actuation of a locking device that, for example, has to be unlocked manually if the safety side part 34 has to be pivoted back from the upright position into the position according to FIG. 3.

Figure 5:
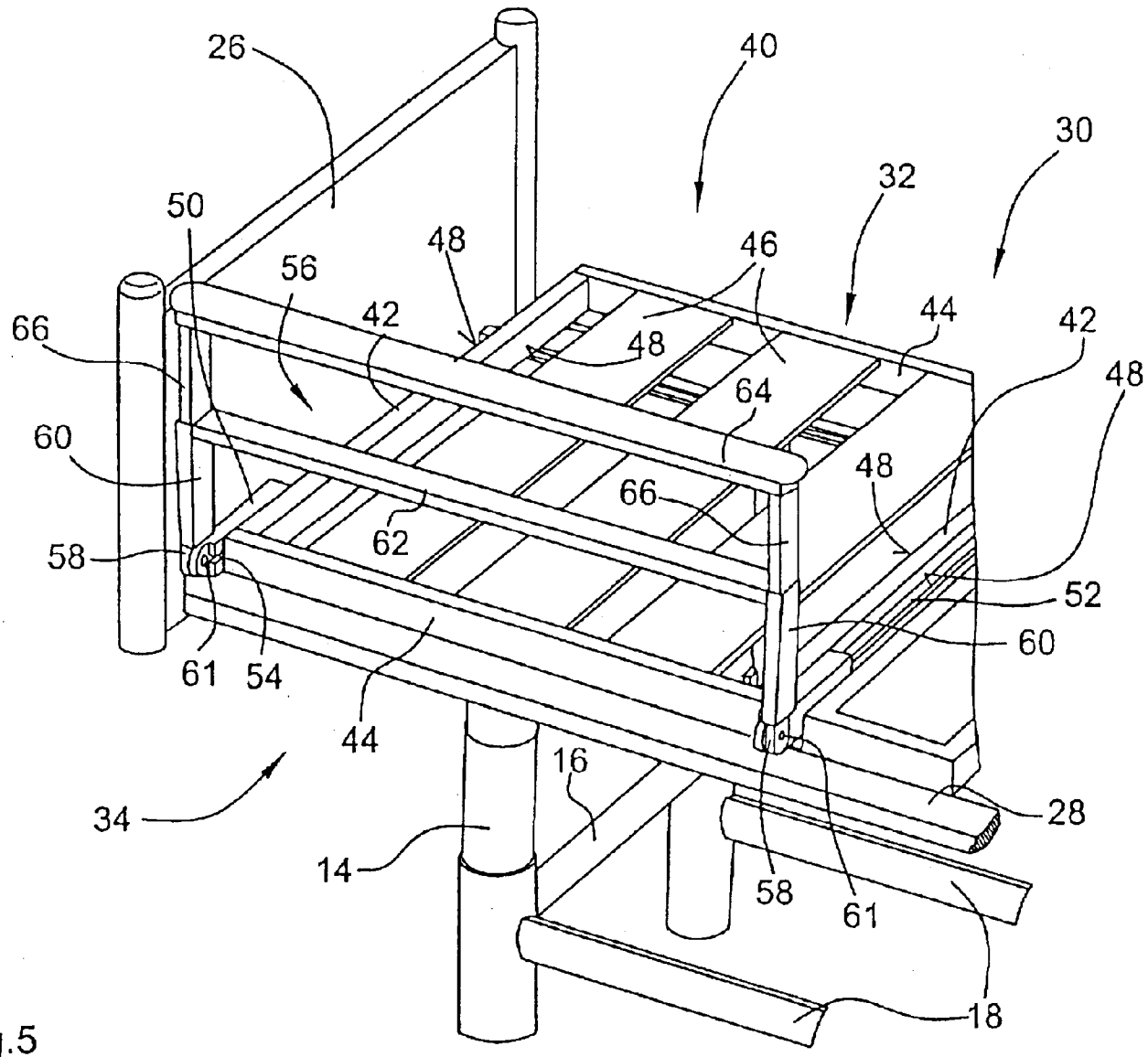
FIG. 5 shows an enlarged representation of the arrangement of the safety side part at the foot-portion side end of the bed in its totally projected upright position.

The height of the safety side part 34 can be enlarged by the afore-described telescopability, which is shown in FIG. 5.

Although the invention has been described and illustrated with reference to specific illustrative embodiments thereof, it is not intended that the invention be limited to those illustrative embodiments. For example, the invention has been described above with respect to a bed where the safety side parts are arranged at adjustable support members of a mattress support device. It is also possible, however, that the safety side parts or, for example, a pair of the safety side parts, are arranged at a stationary part of the mattress support device. Those skilled in the art will recognize that variations and modifications can be made without departing from the true scope of the invention as defined by the claims that follow. It is therefore intended to include within the invention all such variations and modifications as fall within the scope of the appended claims and equivalents thereof.

What is claimed is:

1. A bed comprising:

a bedstead comprising supporting elements for supporting the bed on a floor and a frame supported by supporting elements, the frame including a head portion, a foot portion and at least one connecting portion for connecting the head portion and the foot portion;

a mattress support device for supporting a mattress, the mattress support device defining a lying surface laterally limited by longitudinal edges, the mattress support device being provided with at least one support member having two transverse bars spaced from each other and extending transversely to the extension of the at least one connecting portion of the bedstead, the two transverse bars each comprising side faces which face each other and which face away from each other; and at least one safety side part supported at the at least one support member of the mattress support device so as to be moved between a rest position, in which the at least one safety side part is located below the lying surface, and an upright position, in which the safety side part extends at the side of the lying surface beyond the latter, wherein the at least one safety side part is movably supported at the side faces of the transverse bars of the at least one support member of the mattress support device, wherein an upper surface of the at least one support member defines a mattress support plane, and wherein upper faces of each of the transverse bars are substantially juxtaposed to the mattress support plane.

2. The bed of claim 1, wherein the at least one safety side part is supported at the side faces of the transverse bars of the at least one support member of the mattress support device, which face away from each other.

3. The bed of claim 1, wherein the at least one safety side part is supported at the transverse bars so as to be displaced between the rest position and a position of maximum withdrawal within the plane defined by the transverse bars of the at least one support member of the mattress support device and is adapted to be pivoted into the upright position in the position of maximum withdrawal.

4. The bed of claim 1, wherein the at least one safety side part comprises a longitudinal bar from which two arms project at the free ends of which a two-part joint element with a joint axle extending parallel to the longitudinal bar is respectively arranged, and that the one joint part of each joint element is connected with an arm and the other joint part is displaceably guided at a side face of a transverse bar of the at least one support member of the mattress support device, respectively.

5. The bed of claim 1, further comprising two bearing blocks allocated to the at least one safety side part, which are guided along guide rails or guide grooves arranged at the side faces of the transverse bars of the at least one support member of the mattress support device and which are connected with the at least one safety side part in an articulated manner.

6. The bed of claim 1, wherein the at least one safety side part is adapted to be locked particularly automatically in the upright position by means of a locking device adapted to be deactivated particularly manually.

7. The bed of claim 1, wherein the two transverse bars of the at least one support member of the mattress support device are connected by two longitudinal bars extending parallel to the at least one connecting portion of the bedstead, for forming a circumferential frame of the support member.

8. The bed of claim 6 or 7, wherein the locking device comprises an actuating element for deactivating, and that the actuating element is arranged at one of the longitudinal bars of the at least one support member of the mattress support device.

9. The bed according to claim 1, wherein the bed is a hospital or nursing bed.

10. A bed comprising:

a lower frame for supporting the bed on a floor; and an upper frame being adaptively coupled to the lower frame, the upper frame including:

a mattress support device for supporting a mattress, the mattress support device having a longitudinal extension and a width extension and includes at least one support member that is provided with at least two transverse bars extending substantially perpendicular to the longitudinal extension and being provided on opposite ends of the at least one support member, the at least two transverse bars having upper surfaces that define a mattress support plane and side surfaces that are substantially perpendicular to the mattress support plane; and a safety side part being movably supported on at least one of the side surfaces of the at least two transverse bars, the safety side part being movable from a first position to a second position, the first position being a rest position in which a portion of the safety side part is located substantially juxtaposed to the mattress support plane and the second position being a safety position in which the portion of the safety side part is located in a position substantially perpendicular to the mattress support plane.

* * * * *